United States Patent [19]

Stoppazzini

[11] Patent Number: 4,881,382

[45] Date of Patent: Nov. 21, 1989

[54] ELECTROMECHANICAL DEVICE FOR DRAWING ALONG SLIDES SUPPORTING THE SAME NUMBER OF THREAD GUIDES IN AN AUTOMATIC FLAT KNITTING MACHINE

[75] Inventor: Benito Stoppazzini, Sala Bolognese, Italy

[73] Assignee: E.M.M. Emiliana Macchine Maglieria S.R.L., Padulle di Sala Bolognese, Italy

[21] Appl. No.: 314,939

[22] Filed: Feb. 24, 1989

[30] Foreign Application Priority Data

Mar. 1, 1988 [IT] Italy ..... 4749/88[U]

[51] Int. Cl.[4] ..... D04B 15/52

[52] U.S. Cl. ..... 66/126 R; 66/127

[58] Field of Search ..... 66/60, 64, 126 R, 127, 66/128, 130, 131

[56] References Cited

U.S. PATENT DOCUMENTS 4,658,603 4/1987 Stoll et al. ..... 66/126 R
4,738,124 4/1988 Stoll et al. ..... 66/127

FOREIGN PATENT DOCUMENTS 221699 11/1961 Austria ..... 66/126 R
62-29539 6/1987 Japan ..... 66/125 R

*Primary Examiner*—Ronald Feldbaum
*Attorney, Agent, or Firm*—Stevens, Davis, Miller & Mosher

[57] ABSTRACT

The device is fitted to a flat knitting machine comprising a carriage moving in a horizontal plane above two needle beds and comprises a casing, fixed to the carriage and supporting a vertical rod, able to slide, to which two cores, lower and upper respectively, in a ferromagnetic material are fixed, while a spring acts on the rod with an upward force; a first coil acts on the lower core in such a way as to exert an upward force on the same lower core and a second coil acts on the upper core in such a way as to exert a downward force on the same upper core.

A vertical anchor plate is fixed to the lower core and is able, depending on the position of the rod, to strike ledges of a slide mounted so that it couples with, and is able to slide along, a bar located above the needle beds.

2 Claims, 3 Drawing Sheets

16b
16a
8
M
17
17a
P
17b
16
15
14

16b
M
P
16
17a
15
14

ELECTROMECHANICAL DEVICE FOR DRAWING ALONG SLIDES SUPPORTING THE SAME NUMBER OF THREAD GUIDES IN AN AUTOMATIC FLAT KNITTING MACHINE

BACKGROUND OF THE INVENTION

The invention relates to an electromechanical device for drawing along slides supporting thread guides designed to be fitted to a flat knitting machine.

DESCRIPTION OF THE PRIOR ART

It is known that automatic flat knitting machines feature rods that are located parallel to and above the needle beds.

Thread guide slides are mounted on these rods so that they couple with them in such a way that they are able to slide along these rods, whilst stops are removably fixed to the same rods, these stops delimiting the stroke of the slides located between two consecutive stops.

The carriage, which slides longitudinally above the needle beds with an outwards and return motion, features anchor plates which are made to move vertically between two extreme positions, lowered (operative) and raised (inoperative) respectively, by means of corresponding electromechanical means.

In the lowered position, each anchor plate strikes a corresponding ledge formed in the slide selected: this causes the latter to be drawn along by means of the carriage.

Close to and at the end-of-stroke position of the slide, suitable cams, formed in the stop in cases where the slide is designed to strike the latter, or in the upper rib of a slide that is already stopped up against the aforesaid stop, serve to disengage the anchor plate from the related ledge by gradually lifting the latter.

The electromechanical means which operate the anchor plate must move the anchor plate itself to the lowered position, at the same time permitting the latter a slight vertical oscillating movement caused both by the cams which enable the aforementioned disengagement, and by the track, formed by the upper ribs of any slides and by the stop located downstream from the slide from which the anchor plate has just become disengaged, over which the lower end of the anchor plate is forced to slide. The anchor plate obviously runs over the aforesaid track in cases where it is intended to draw a further slide along, downstream of the stop, as a consequence of the anchor plate's striking the ledge formed in this said slide.

The above-mentioned electromechanical means must, in addition, set the related anchor plate in its raised position: in this situation the anchor plate cannot strike the thread guide slides.

In the solution known today the aforementioned electromechanical means comprise a coil that works in conjunction with a ferromagnetic core that can be moved between two extreme positions: the aforementioned anchor plate is fixed to the said core.

Powering the coil with one polarity or another brings the anchor plate to the aforementioned lowered and raised positions.

The raised position, with the anchor plate disengaged from the ledge, may be obtained by energising the coil with a present current value; the abovementioned position, when the anchor plate is in the stage of drawing along the slide, requires a signal with a higher current than the previous one, in that it is on the one hand necessary to overcome the friction between the anchor plate and ledge, and, on the other, because the switch over from the lowered to the raised position must be effected with the greatest rapidity.

The same coil is of necessity used to set the anchor plate in its two extreme positions; this requires a corresponding power supply which must in some cases, as pointed out, send signals with a considerable current value.

During operation, the coil is of necessity energised for both positions, which causes it to overheat, frequently causing the machine to go out of order, and requiring increased complexity of the circuits for checking and adjusting this power supply.

It should be emphasised that the dimensions of the above-mentioned electromechanical means must be as compact as possible, in that the carriage features a series of similar means located alongside one another, and the overall space available is not only limited but also occupied by other operating means.

SUMMARY OF THE INVENTION

The object of the present invention is to propose an electromechanical device for operating the anchor plate for drawing along corresponding slides, designed in such a way as to provide an optimised solution to the problems involved in drawing along the slides located on the same bar by means of an anchor plate, in gradually disengaging the anchor plate from the slide, as well as in rapidly disengaging the anchor plate from the slide at an intermediate point in its related stroke.

A further object of the invention is to propose a device as above which, in addition to that proposed above, is also reliable over time, functional and extremely rapid in its operations.

The above objects are obtained by proceeding in accordance with that proposed in claim 1.

BRIEF DESCRIPTION OF THE DRAWINGS

The characteristics of the invention are emphasised hereinafter with specific reference to the enclosed drawings, in which.

Figure 1:
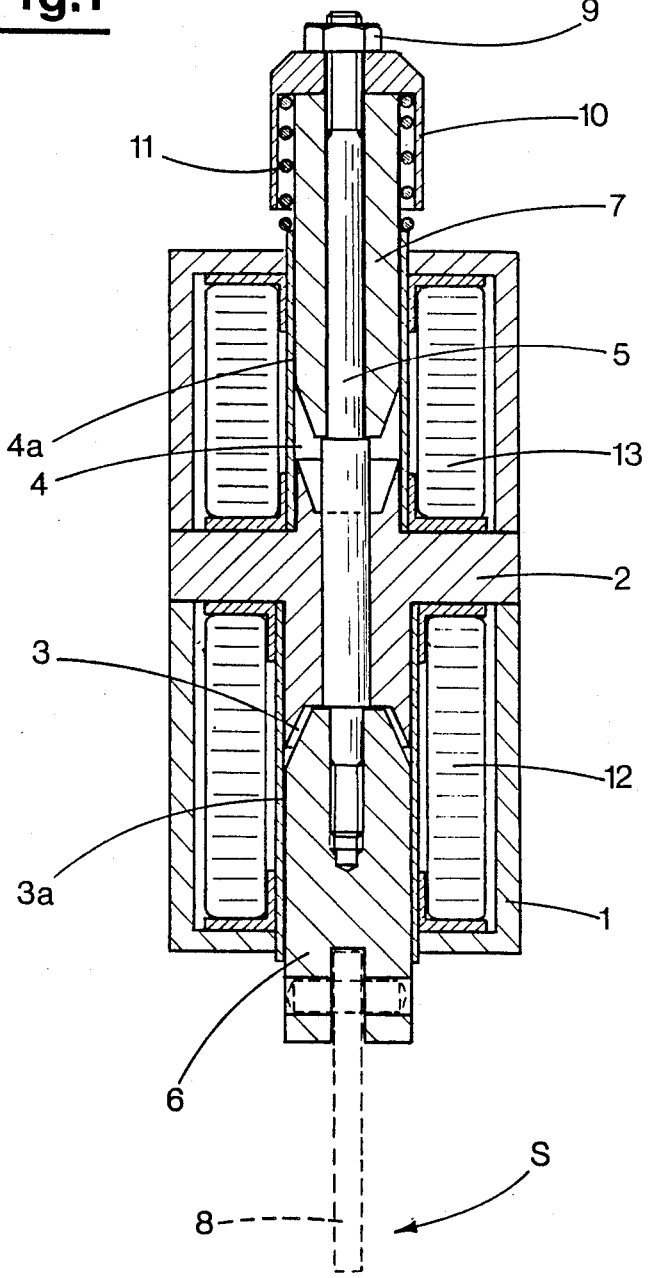
FIGS. 1 and 2 are lateral axial sections of the present device with the mobile unit of the latter in the extreme raised and lowered positions respectively.
Figure 2:
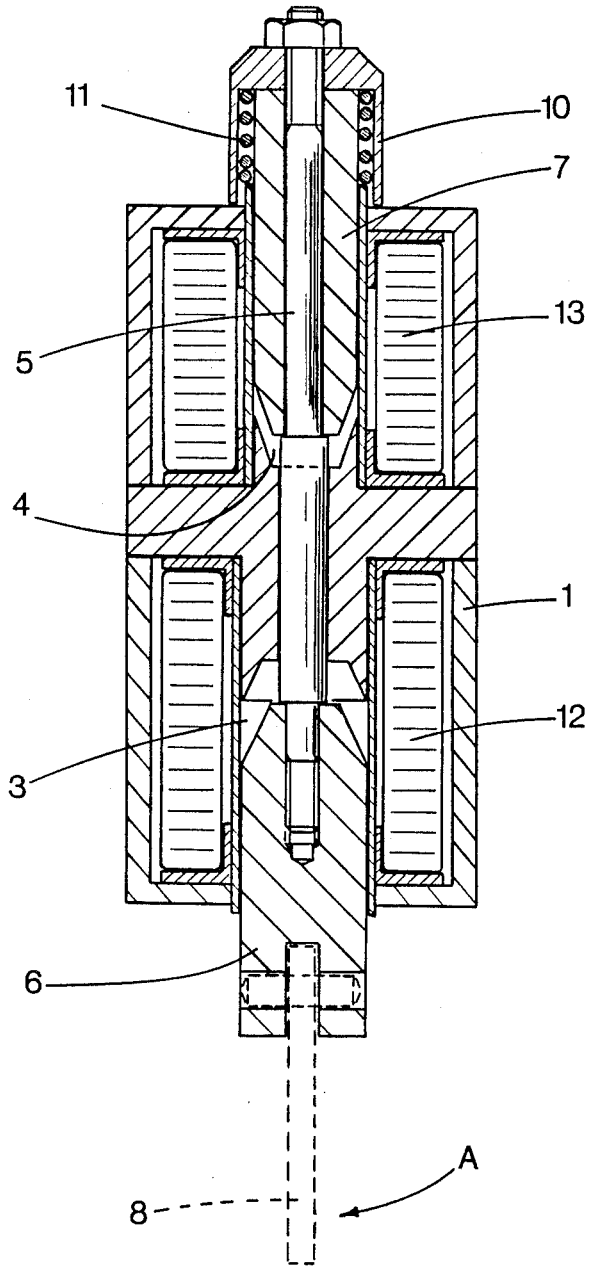

FIGS. *3a*, *3b* are diagrammatic illustrations of certain operational aspects regarding the system for drawing along a slide by means of an anchor plate that forms an integral part of the aforementioned mobile unit.

DESCRIPTION OF THE PREFERRED EMBODIMENT

With reference to these figures, 1 indicates a casing comprising a central body 2 located between two seats 3 and 4, first and second respectively, that are coaxial to one another and are open to the outside on opposite sides.

The casing is fixed to the moving carriage (not illustrated) of a flat knitting machine in such a way as to position the axes of the seats 3, 4 in a vertical plane.

The body 2 features an axial hole that passes through it, a rod 5 moving freely within this hole, its ends mounting the same number of cores 6, 7, lower and upper respectively, in an electromagnetic material.

The lower core 6 is guided by the first seat 3, whilst the upper core 7 is guided by the second seat 4.

An anchor plate 8 (which will be described in greater detail below) is fixed to the lower core 6, facing downwards.

The rod 5 protrudes from the upper core 7 to which it is fixed, using known means 9, with a downwards-facing cap 10 being interposed between them.

A spring 11 is located between the said cap and the adjacent head of the casing, this spring 11 acting on the mobile unit, comprising the rod 5 and related cores 6, 7, with an upward force; this causes the mobile unit to be raised, if there are no other forces acting upon it, until the inside head of the lower core 6 strikes against the central body 2 (see FIG. 1): this represents the extreme raised position S of the anchor plate 8.

A first coil 12 is located between the bush 3a delimiting the seat 3 and the casing 1, this coil 12, when energised, exerting an upward axial force on the lower core 6.

A second coil 13 is located between the bush 4a deliminating seat 4 and the casing 1.

Energising the second coil 13, and obviously doing so when the first coil 12 is de-energised, causes a downward axial force to be exerted on the upper coil 7.

This latter force is sufficient to overcome the elastic reaction of the spring 11, therefore causing the above-mentioned mobile unit to be lowered until the cap 10 strikes against the casing 1: this represents the extreme lowered position A of the anchor plate 8.

In this condition the inside head of the upper core 7 is moved away from the central body 2.

Figures 3A, 3B:
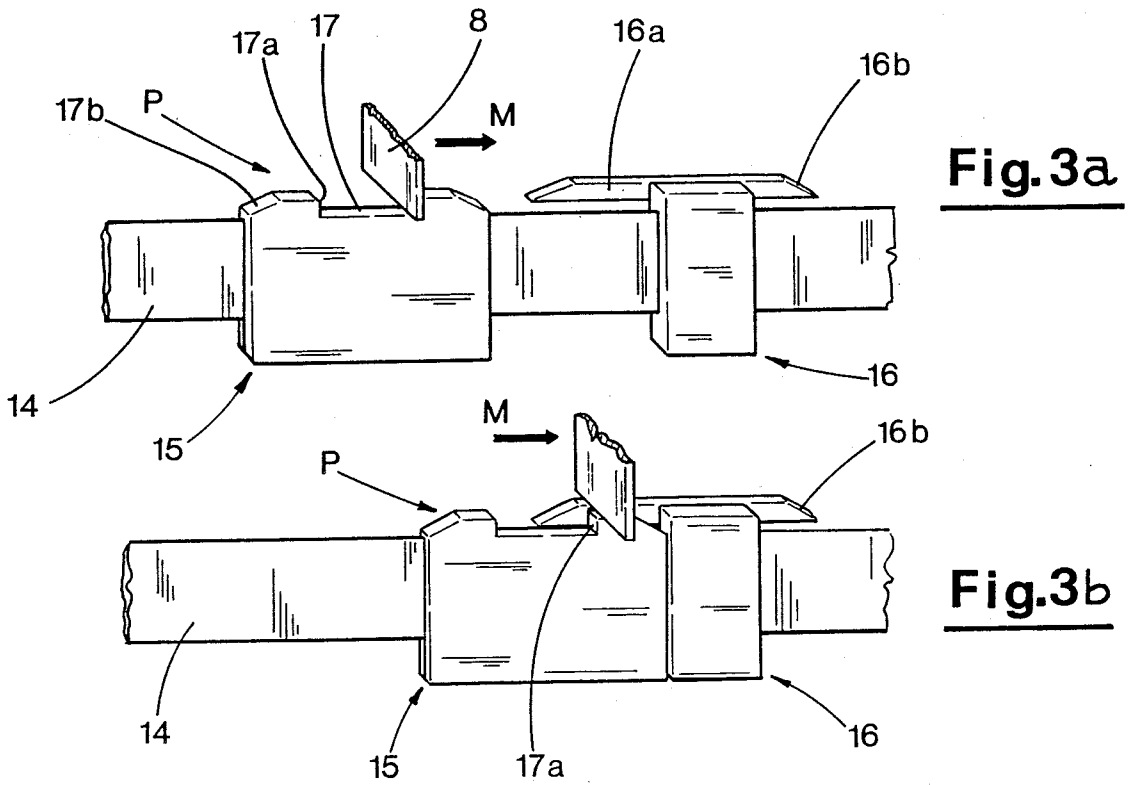

With reference to FIGS. 3*a* and 3*b*, 14 indicates a bar located parallel to and above the needle beads (not illustrated) of a flat knitting machine.

Slides 15 (only one of which is illustrated) are mounted on the said bar so that they couple with it in a complementary fashion, stops 16, (only one of which is illustrated), in addition being removably fixed to the same said bar; it should be emphasised that the slide 15 and stop 16 illustrated in FIGS. 3*a* and 3*b* are of known type and not pertinent to the invention.

The upper ribs of the slide and stop form sliding tracks indicated by P; a cutout 17 is formed in the rib of the slide, being laterally delimited by ledges 17*a*; the first part of the slide's rib features ramps 17*b* (see FIGS. 3*a*, 3*b*).

The rib of the stop 16 is formed by a cam 16*a*, beside which the rib of the slide is positioned when the latter strikes the same stop, whose ends feature ramps 16*b*.

In FIG. 3*a*, the anchor plate 8 is in the lowered position A, following the energising of coil 13, striking against the ledge 17*a* involved when the carriage is moving in direction M; the slide being drawn in direction M by means of the anchor plate.

Ramp 16*b* of stop 16 is struck by the anchor plate 8 close to the stop 16 itself; consequently, the anchor plate is gradually raised.

The force exerted by coil 13 on the upper core 7 is a downward force (opposing the elastic reaction of the spring 11) that is however of a value permitting the aforementioned unit, and thus the anchor plate 8, to move with a slight oscillating motion, with the said oscillation being caused by the lower end of the anchor plate sliding over the track P.

The pressure with which the anchor plate is kept pressed against the track P must not be so high as to subject the slides and stops to undue stress, whilst it must at the same time limit the flexing stresses to which the anchor plate itself is subjected to acceptable values.

This may be effected in an optimised manner by operating on the elastic constant of the spring 11 and, mainly, on the energising current of the coil 13.

The above situation enables the anchor plate to travel along the cam 16*a*, the ramp 16*b* of the latter, (the one downstream), the rising ramp of a slide 15 downstream of the stop 16 and finally strike the corresponding ledge 17*a* of this latter slide.

The coil 13 is de-energised at the end of the stroke of the carriage in one direction (in direction M, for example); the action of the spring 11 is such that it brings the anchor plate 8 into its raised position S, which is to say up to a height ensuring that the anchor plate cannot in any way strike the slides.

In the above situation, the raised position S is obtained without energising either of the coils.

The function of coil 12 is to enable the anchor plate 8 to be rapidly disengaged from the ledge 17*a* whilst the slide is being drawn along (as illustrated, by way of example, in FIG. 3*a*).

Coil 12 is, to this end, oversized in relation to coil 13, so that it can very rapidly, as a result of being energised with a suitable current, generate a force that is sufficient to effect the above-mentioned extremely rapid disengagement notwithstanding the friction existing between the faces of the anchor plate 8 and ledge 17*a*, in full contact with one another.

In the above situation, the spring 11 has an action similar to that of the force generated by the coil 12 on the core 6.

The proposed device is extremely versatile.

It indeed makes it possible to continually adjust the force with which the anchor plate 8 is maintained in the lowered position A (simply by varying the energising current).

In addition to this, it enables one to obtain the raised position S without giving rise to any thermal stress; both coils indeed being de-energised, and this position being obtained through the action of the spring 11.

It finally enables rapid disengagement to be effected even during the stage when the slide is being drawn along, by energising coil 12.

The proposed device is suitable for control by a programmed unit, in that the coils may be energised independently of one another.

The transverse section of the device does not exceed the sections of the known devices referred to in the introduction.

It is understood that the description supplied herein is solely an unlimited example, such that possible variations of a practical or applicationoriented nature to the construction details of the technical solution described will not affect the protective framework afforded to the invention as described above and claimed hereinafter.

What is claimed is:

1. An electromechanical device for drawing along slides, supporting a same number of thread guides, of an automatic flat knitting machine, with said machine comprising: a carriage that is made to move with an outward and return motion above needle beds of said machine; at least one bar, located parallel to and above said needle beds, with said slides mounted upon and coupled with said bar in such a way that said slides are able to slide along said bar; a plurality of stops removably mounted on said bars, said stops delimiting a stroke os said slides located between two consecutive said stops, with upper surfaces of said stops and slides having a shape designed to form a sliding track, each slide featuring at least two vertical ledges, laterally deliminating a cutout in the upper rib of said slide; and with said device being comprising: a casing including a central body located between two coaxial seats, first and second respectively, with said seats being open to the outside, said casing being fixed to said carriage in such a way as to position the axes of said seats in a vertical plane; two cores, lower and upper respectively, in a ferromagnetic material, which are inserted in such a way that they are able to slide in said first and second seats respectively, said cores being connected to one another by means of a rod inserted into a hole that passes through said central body, a downward-facing anchor plate being fixed on the outside to said lower core; elastic means acting on said cores and rod, with an upward axial force able to lift said cores when there are no outside forces acting on said cores, consequently positioning said anchor plate in an extreme raised position in which said anchor plate does not strike said tracks of said slides; a first coil located in a an annular chamber surrounding said first seat, designed, as a result of being energised, to exert an upward axial force on said lower core in agreement with the action of said elastic means, very rapidly raising said cores and consequently bringing said anchor plate to said raised position; a second coil, located in an annular chamber surrounding said second seat, designed, as a result of being energised, dependent upon said first coil being de-energised, to exert a downward axial force on said upper core, in opposition to said action of said elastic means, lowering said cores and consequently bringing said anchor plate to an extreme lowered position, in which said anchor plate strikes one of said ledges of a corresponding slide depending upon the direction of movement of said carriage, said downward force, although opposed by said elastic means, being suitable to permit said cores to move with a slight vertical oscillating motion caused by said anchor plate sliding over said tracks.

2. Device as in claim 1, wherein a cap is fixed to an upper end of said upper magnetic core, with said elastic means located between said cap and an adjacent head of said casing, and wherein said anchor plate is in said extreme lowered position when said cap strikes said head as a result of said cores being lowered.

* * * * *